US007391989B2

(12) United States Patent
Kim et al.

(10) Patent No.: US 7,391,989 B2
(45) Date of Patent: Jun. 24, 2008

(54) ELECTROPHOTOGRAPHIC IMAGE FORMING APPARATUS

(75) Inventors: Young-min Kim, Suwon-si (KR); Byung-sun Ahn, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 64 days.

(21) Appl. No.: 10/921,147

(22) Filed: Aug. 19, 2004

(65) Prior Publication Data

US 2005/0105932 A1 May 19, 2005

(30) Foreign Application Priority Data

Nov. 19, 2003 (KR) ..... 10-2003-0082344

(51) Int. Cl.
*G03G 15/00* (2006.01)

(52) U.S. Cl. ..... 399/107

(58) Field of Classification Search ..... 399/107, 399/124, 125

See application file for complete search history.

(56) References Cited

U.S. PATENT DOCUMENTS

| | | | | | |
|---|---|---|---|---|---|
| 4,162,843 | A | * | 7/1979 | Inoue et al. | 399/179 |
| 4,384,781 | A | * | 5/1983 | Takada | 399/122 |
| 4,752,801 | A | * | 6/1988 | Kando | 347/138 |
| 4,754,293 | A | * | 6/1988 | Aizawa et al. | 347/138 |
| 4,806,970 | A | * | 2/1989 | Nakatomi et al. | 399/122 |
| 4,941,002 | A | * | 7/1990 | Maruyama et al. | 347/138 |
| 4,965,640 | A | * | 10/1990 | Watarai et al. | 399/122 |
| 5,141,222 | A | * | 8/1992 | Sawada et al. | 271/292 |
| 5,155,537 | A | * | 10/1992 | Komatsu et al. | 399/391 |
| 5,160,964 | A | * | 11/1992 | Takahashi et al. | 399/113 |
| 5,204,713 | A | * | 4/1993 | Yamamura | 399/119 |
| 5,245,357 | A | * | 9/1993 | Maruyama et al. | 346/134 |
| 5,253,013 | A | * | 10/1993 | Takano et al. | 399/130 |
| 5,255,061 | A | * | 10/1993 | Matsuura et al. | 399/124 |
| 5,479,245 | A | * | 12/1995 | Hino et al. | 399/31 |
| 5,512,975 | A | * | 4/1996 | Kitsu et al. | 399/130 |

FOREIGN PATENT DOCUMENTS

| | | | |
|---|---|---|---|
| JP | 62-234167 | | 10/1987 |
| JP | 62-234170 | | 10/1987 |
| JP | 63015263 | A * | 1/1988 |
| JP | 03-92869 | | 4/1991 |
| JP | 04-333063 | | 11/1992 |

(Continued)

OTHER PUBLICATIONS

Korean Office Action issued on Sep. 27, 2005, for KR 2003-0082344.

*Primary Examiner*—Quana M Grainger
(74) *Attorney, Agent, or Firm*—Stanzione & Kim, LLP

(57) ABSTRACT

An electrophotographic image forming apparatus may include a developing unit installed above a photosensitive drum, a pickup roller installed above a photosensitive drum to draw a sheet of paper from a paper feed cassette, and a paper transportation path extended below from the pickup roller. An exposure unit and the paper transportation path are installed in rear and front sides of a housing, respectively, to interpose the developing unit therebetween. The developing unit includes a developing roller and a toner container extended above from a front end of a bottom of the housing, the toner container having a height longer than a width.

16 Claims, 8 Drawing Sheets

FOREIGN PATENT DOCUMENTS

| | | | |
|---|---|---|---|
| JP | 08-262827 | | 10/1996 |
| JP | 11-15227 | | 1/1999 |
| JP | 11344910 A | * | 12/1999 |
| JP | 2000-98758 | | 4/2000 |
| JP | 2002-182539 | | 6/2002 |
| JP | 2003-1902 | | 1/2003 |
| KR | 93-10635 | | 6/1993 |

* cited by examiner

ELECTROPHOTOGRAPHIC IMAGE FORMING APPARATUS

CROSS-REFERENCE TO RELATED APPLICATIONS

This application claims the priority of Korean Patent Application No. 2003-82344, filed on Nov. 19, 2003, in the Korean Intellectual Property Office, the disclosure of which is incorporated herein in its entirety by reference.

BACKGROUND OF THE INVENTION

1. Field of the Invention

The present general inventive concept relates to an electrophotographic image forming apparatus.

2. Description of the Related Art

In general, an electrophotographic image forming apparatus forms an electrostatic latent image corresponding to a desired image by radiating light on a photosensitive medium, forms a toner image by supplying toner to the electrostatic latent image, and prints an image by transferring and fixing the toner image on a recording medium.

FIG. 1 schematically illustrates a conventional electrophotographic image forming apparatus.

Referring to FIG. 1, a photosensitive drum 2, a developing unit 3, and an exposure unit 4 are installed above a paper transportation path 1, a transfer roller 5 and a paper feed cassette 8 are installed below the paper transportation path 1. The exposure unit 4 is installed above the photosensitive drum 2 to form the electrostatic latent image by radiating light on the photosensitive drum 2. The developing unit 3 includes a toner container 6 containing toner. A developing roller 7 is installed at a front end of the toner container 6. Toner is supplied to the electrostatic latent image by the developing roller 7, and a toner image is formed on the photosensitive drum 2. Through a transfer nip where the photosensitive drum 2 faces the transfer roller 5, the toner image is transferred on a sheet of paper S supplied from the paper feed cassette 8. A fixing unit 9 fixes the toner image on the sheet of paper S by applying heat and pressure to the toner image.

Referring to FIG. 1, the toner container 6 is extended transversely from the front end of the toner container 6 where the developing roller 7 is located. In order to perform a printing process at a high speed and extend a life span of the developing unit 3, there is a tendency that a volume of the toner container 6 becomes enlarged. The toner container 6 must be extended transversely in order to enlarge the volume of the toner container 6 while maintaining the image forming apparatus in a slim size. As the volume of the toner container 6 is enlarged as described above, a footprint of the image forming apparatus becomes large. Considering that the image forming apparatus is chiefly used in an office, it is desirable to have a smaller footprint. Also, it is difficult to transfer toner disposed in a place 10 far away from the front end of the toner container 6 although an agitator 11 is installed for stirring the toner as shown in FIG. 1. Therefore, a toner consumption efficiency depreciates because all toner in the toner container 6 may not be used for an image forming process.

SUMMARY OF THE INVENTION

In order to solve the foregoing and/or other problems, it is an aspect of the present general inventive concept to provide an eletrophotographic image forming apparatus to minimize a footprint of the same and to enhance a toner consumption efficiency.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an eletrophotographic image forming apparatus including a print unit which prints an image on a sheet of paper using an electrophotographic process and a housing containing the print unit, the printing unit including a photosensitive drum, an exposure unit to form an electrostatic latent image by radiating light corresponding to image information on the photosensitive drum, a developing unit installed above the photosensitive drum to develop the electrostatic latent image by supplying toner to the electrostatic latent image, a pickup roller installed above the photosensitive drum to draw the sheet of paper from a paper feed cassette, and a paper transportation path extended below from the pickup roller to guide the sheet of paper to an outlet provided in the housing, in which the paper transportation path and the exposure unit are installed in rear and front sides of the housing, respectively, to interpose the developing unit therebetween.

In an aspect of the present general inventive concept, the developing unit may include a toner container to contain toner, and a developing roller installed at a front end of the toner container to form a toner image obtained by supplying the toner on the electrostatic latent image, The toner container may be extended upward from the front end within a range of ±45° vertically from the front end thereof and may have a height longer than a width. The developing roller may be installed within a range of ±45° vertically from a center of the photosensitive drum.

In another aspect of the present general inventive concept, the pickup roller may be installed within the range of ±45° vertically from the center of the photosensitive drum.

In another aspect of the present general inventive concept, the electrophotographic image forming apparatus may further include a stand to support the housing in order to form a loading space between a bottom of the housing and an installation surface of the stand. In this case, the stand pivatably supports the housing.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
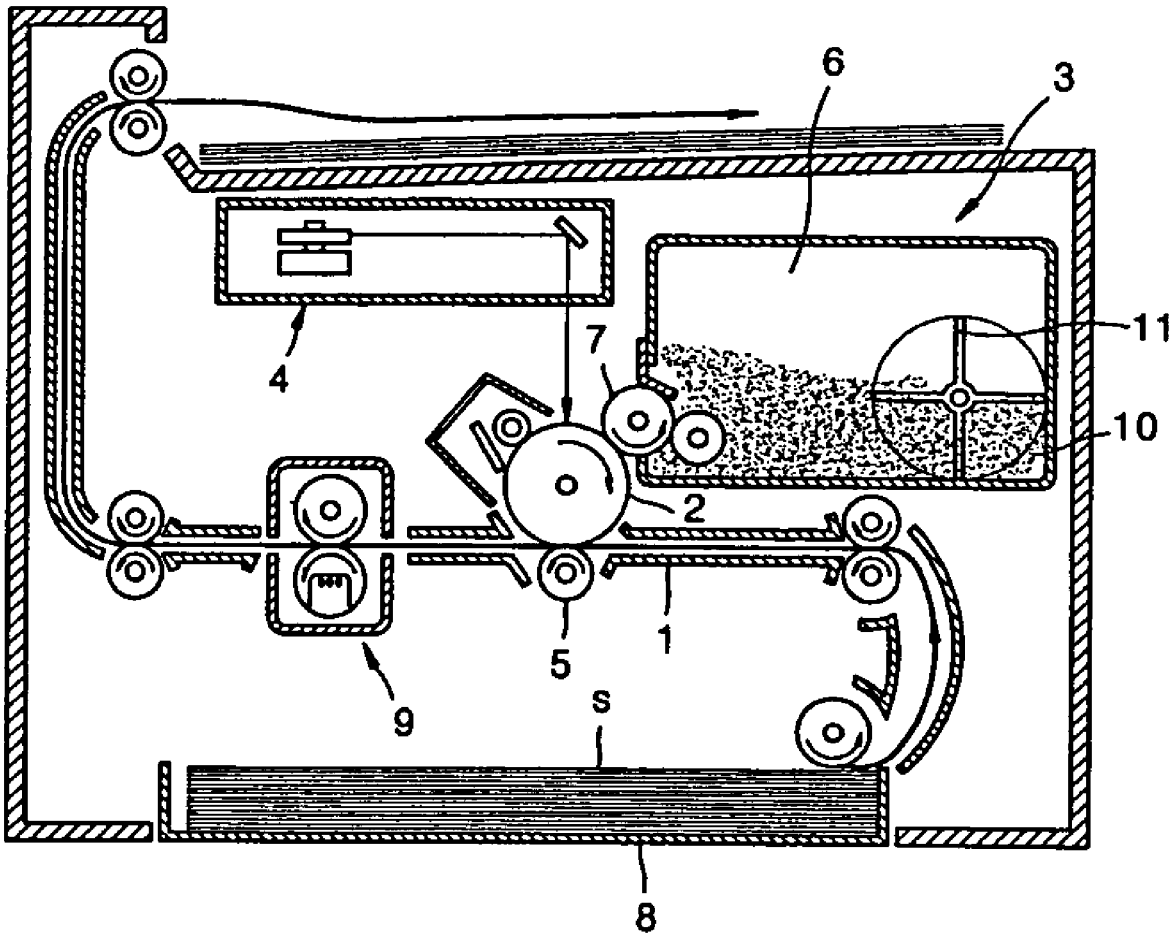
FIG. 1 (PRIOR ART)
FIG. 1 is a diagram schematically illustrating a conventional electrophotographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
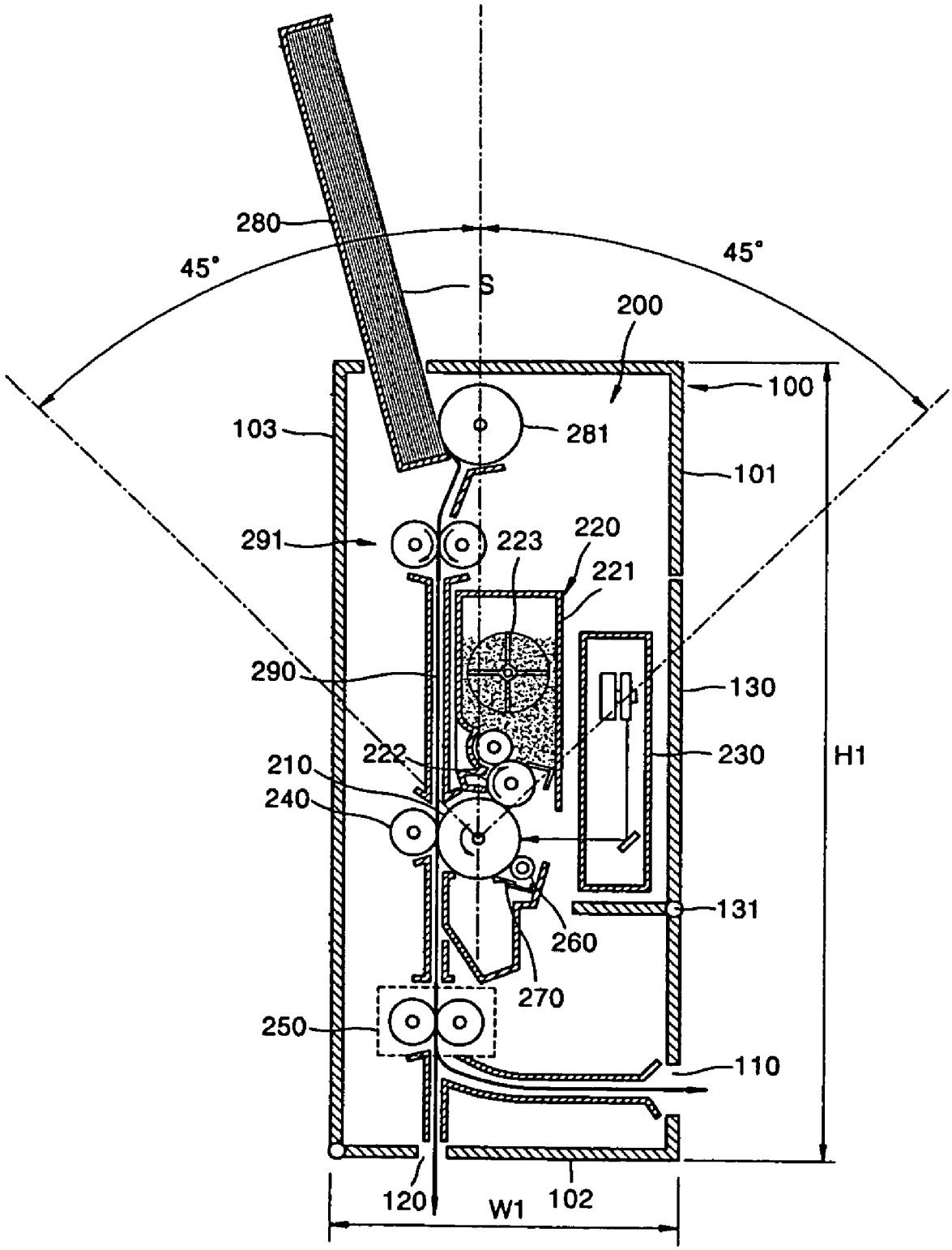
FIG. 2 is a side cross-sectional view illustrating an electrophotographic image forming apparatus according to an embodiment of the present general inventive concept.

FIG. 2 is a cross-sectional view illustrating an electrophotographic image forming apparatus according to an embodiment of the present invention. Referring to FIG. 2, a print unit 200 can include a photosensitive drum 210, a developing unit 220, an exposure unit 230, a transfer roller 240, a fixing unit 250 and can be contained in a housing 100 which forms an external appearance of the image forming apparatus. Outlets 110 and 120 can be provided on a front surface (front side) 101 and/or a lower surface (bottom side) 102 of the housing 100 to discharge sheets of paper S.

The photosensitive drum 210 can be a metallic drum having a circumference on which a photoconductive substance layer is formed. The exposure unit 230 can form an electrostatic latent image by radiating light corresponding to image information on the photosensitive drum 210 charged with a uniform electrical potential. A laser scanning unit LSU which uses at least one laser diode as a source of light can generally be used as the exposure unit 230. The developing unit 220 can contain solid powder of toner and forms a toner image by supplying the toner to the electrostatic latent image formed on the photosensitive drum 210. The transfer roller 240 can be installed to face the photosensitive drum 210 to form a transfer nip. A transfer bias can be applied to the transfer roller 240 to transfer the toner image formed on the photosensitive drum 210 on the sheet of paper S passing through the transfer nip. A corona discharging unit (not shown) may be used instead of the transfer roller 240. The fixing unit 250 can fix the toner image on the sheet of paper S by applying heat and pressure to the toner image transferred on the sheet of paper S. A reference numeral 260 denotes a charging unit which charges the photosensitive drum 210 to the uniform electric potential. A reference numeral 270 denotes a cleaning blade, which eliminates toner remaining on an outer circumference of the photosensitive drum 210 after the toner image is transferred on the sheet of paper S.

A reference numeral 280 denotes a paper feed cassette to accommodate the sheet of paper S. A reference numeral 281 denotes a pickup roller drawing the sheet of paper S from the paper feed cassette 280. A paper transportation path 290 is formed to extend down from the pickup roller 281 to the outlets 110 and 120 of the housing 100 through the transfer nip where the transfer roller 240 faces the photosensitive drum 210, and the fixing unit. A plurality of guide rollers (not shown) including a feed roller 291 to transport the sheet of paper S may be provided in the paper transportation path 290.

In accordance with the configuration as described above, the electrostatic latent image can be formed by radiating light corresponding to the image information from the exposure unit 230 on the outer circumference of the photosensitive drum 210 charged to the uniform electric potential by the electrifying unit 260. The toner image can be formed on the electrostatic latent image by supplying toner from the developing unit 220. As the front end of the toner image reaches the transfer nip, the sheet of paper S drawn from the paper feed cassette 280 by the pickup roller 281 can be fed along the paper transportation path 290. The toner image can be transferred on the sheet of paper S by a transfer bias applied to the transfer roller 240, and a print of an image can be completed with the sheet of paper S passing through the fixing unit 250. The sheet of paper S can be discharged through the outlets 110 or 120 out of the housing 100. Rollers (not shown) to discharge the sheet of paper S may be provided on the outlets 110 and 120.

In an aspect of the present general inventive concept, the electrophotographic image forming apparatus can be distinguished from other image forming apparatuses because the pickup roller 281, the paper transportation path 290, the developing unit 220, and the exposure unit 230 around the photosensitive drum 210 can be arranged to minimize a size of a footprint (an area of a bottom or a base) of the electrophotographic image forming apparatus. A depth of the electrophotographic image forming apparatus can be a parameter decided by a width [W1] of the sheet of paper S used in the electrophotographic image forming apparatus. And a height H1 of the electrophotographic image forming apparatus may not affect the footprint. Therefore, the width W1 of the electrophotographic image forming apparatus may be decreased so as to reduce the footprint.

Referring to FIG. 2, the developing unit 220 is installed above the photosensitive drum 210, and the paper transportation path 290 and the exposure unit 230 are installed in the both sides of the developing unit 220, namely, a rear side 103 and the front side 101 of the housing 100. The exposure unit 230 may be installed vertically as shown in FIG. 2. Also, the pickup roller 281 may be installed above the photosensitive drum 210, and a position of the pickup roller 281 may be within a range of ±45°, more preferably ±30°, vertically from a center of the photosensitive drum 210. The center of the photosensitive drum 210 is disposed on a line parallel to a major portion of the paper transportation path 290. If the pickup roller 281 is installed out of the range of ±45°, the pickup roller 281 may slant with respect to the width, and the width W1 may be difficult to decrease. The paper feed cassette 280 may be installed vertically as shown in FIG. 2.

Figure 3:
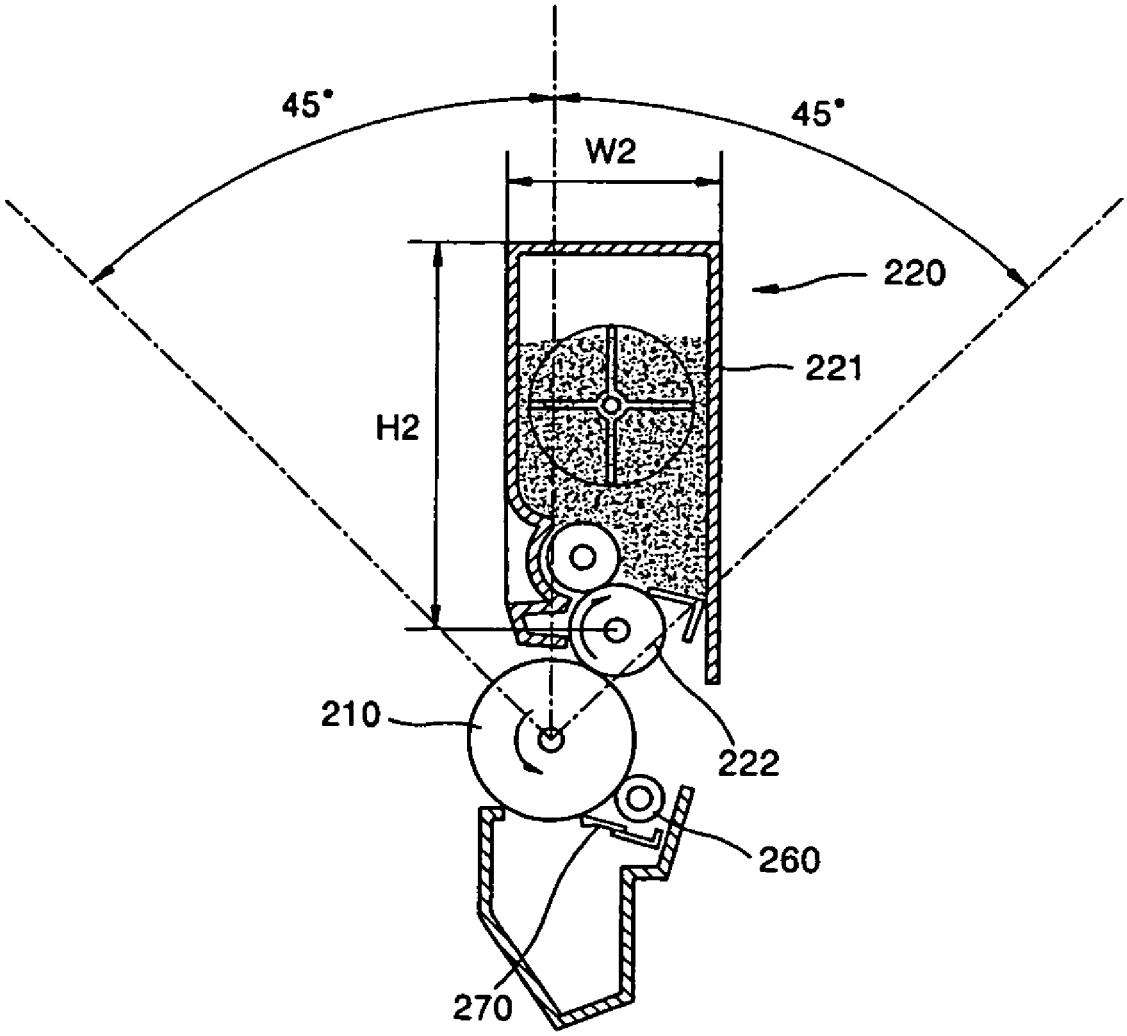
FIG. 3 is a cross-sectional view illustrating a developing unit illustrated in FIG. 2.

The developing unit 220 may have a form (shape) to reduce the footprint of the electrophotographic image forming apparatus and to maximize the containing volume of toner. Referring to FIG. 3, the developing unit 220 may include a toner container 221 to contain the toner and a developing roller 222 installed at a front end of a bottom of the toner container 221. The developing roller 222 can supply the toner from the toner container 221 to the photosensitive drum 210 in order to develop the electrostatic latent image. The developing roller 222 may be installed in the range of ±45° vertically from the center of the photosensitive drum 210 according to the same reason as the case of the pickup roller 281. The toner container 221 may be formed to extend upward from the front end at which the developing roller 222 is located, and a height H2 (FIG. 3) of the toner container 221 may be longer than a width W2 of the same.

In accordance with the structure as described above, the footprint can be reduced by lessening the width W1 of the electrophotographic image forming apparatus. In accordance with a conventional electrophotographic image forming apparatus of FIG. 1, since a toner container 6 is extended wide, there is a problem in transporting toner disposed in a place 10 far from a developing roller 7 to the developing roller 7. However, in accordance with the electrophotographic image forming apparatus according to the present embodiment, the toner container 221 can be extended vertically, the toner in the toner container 221 can be transported to the developing roller 222 by its own weight. Therefore, there is an advantage capable of using all toner in the toner container 221 in a developing process. Also, referring to FIGS. 2 and 3, if an agitator 223 is installed in the toner container 221, the toner can be easily transported to the developing roller 222. Two or more agitators 223 may be installed. The agitator 223 may be installed at a place far from the developing roller 222. Also, it is possible to reduce the occurrence of a paper jam because the paper transportation path 290 is formed almost straight from an upper part to a lower part of the housing 100 of the image forming apparatus.

Figure 4:
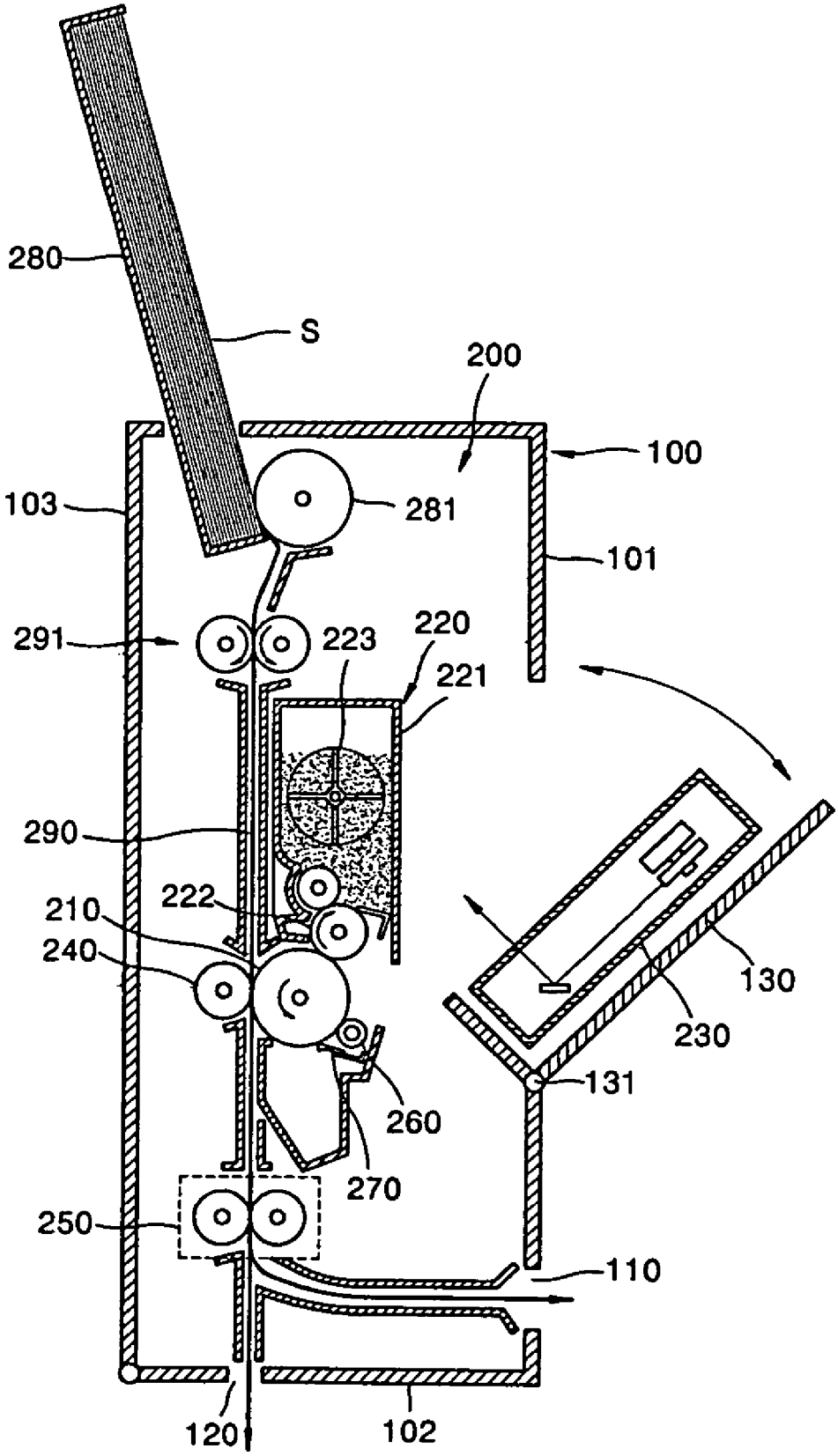
FIG. 4 is a cross-sectional view illustrating an opened state of a door of the electrophotographic image forming apparatus shown in FIG. 2.

Referring to FIG. 4, a door 130 can be installed at the front surface 101 of the housing 100 to exchange the developing unit 220. The door 130 can be installed on a hinge 131. In this case, the exposure unit 230 may be installed on the door 130 in order to rotate with the door 130. In accordance with the configuration as described above, the developing unit 220 can be easily replaced at the front of the electrophotographic image forming apparatus.

Figure 5:
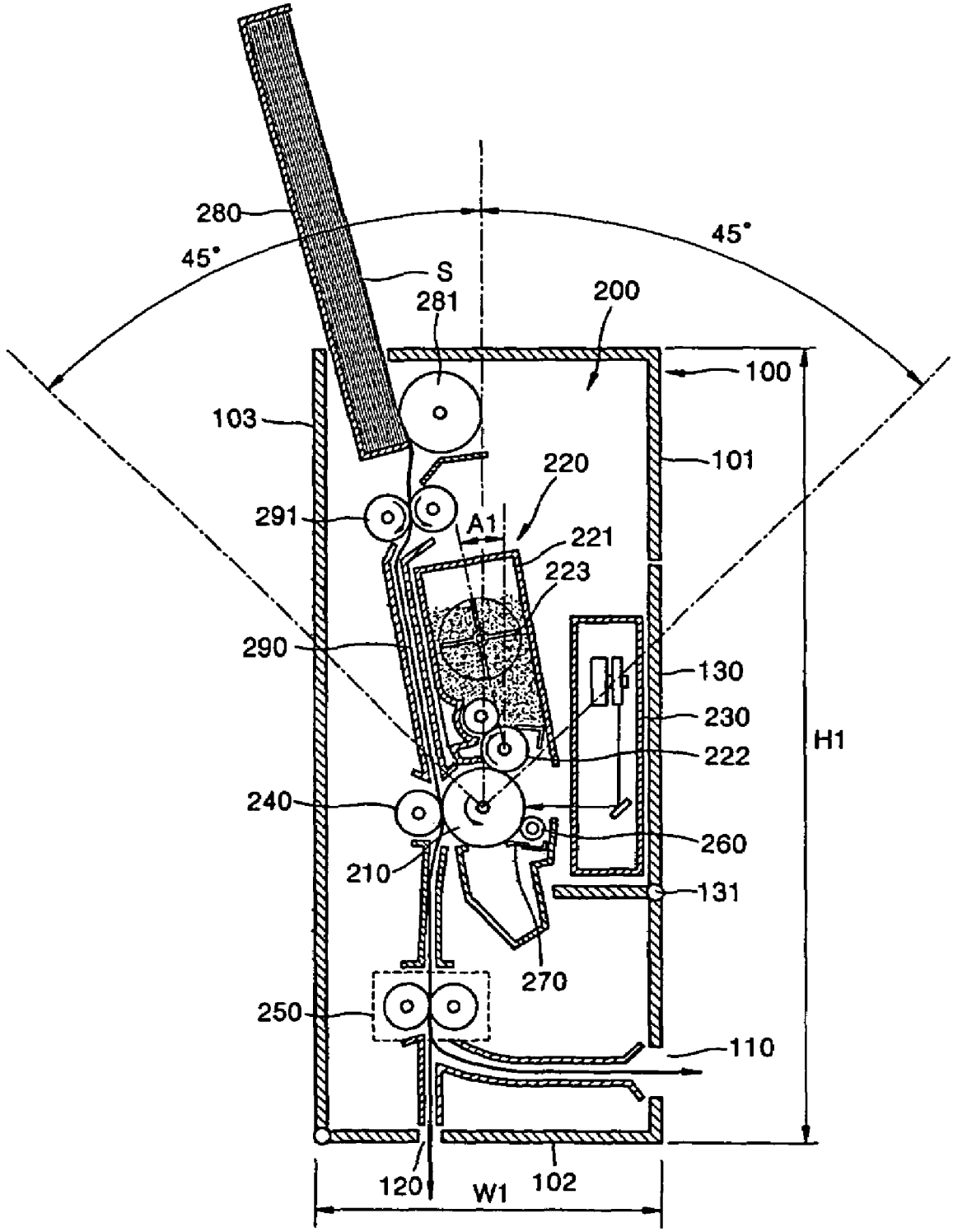
FIG. 5 is a side cross-sectional view illustrating an electrophotographic image forming apparatus according to another embodiment of the present general inventive concept.

FIG. 5 is a side cross-sectional view illustrating an electrophotographic image forming apparatus according to another embodiment of the present general inventive concept. Hereinafter, the element having same functions may be indicated with same reference character, and explanations repeated are omitted. Referring to FIGS. 2 and 5, the toner container 221 slants vertically. A slope angle A1 may be within the range of ±45° vertically. If the slope angle is out of the range of ±45°, it may be difficult to lessen the width W1 due to an inclination of the toner container 221 with respect to the housing 100 as explained of the installation place of the pickup roller 281 and developing roller 222. Also, if the toner container 221 has the slope angle A1 out of the range of ±45°, it may be difficult to transport toner in the toner container 221 to the developing roller 222. In other words, mobility in a free fall direction of the toner by its own weight of the toner is decreased because a horizontal component of the weight of the toner is bigger than a vertical component of the weight of the toner.

Figure 6:
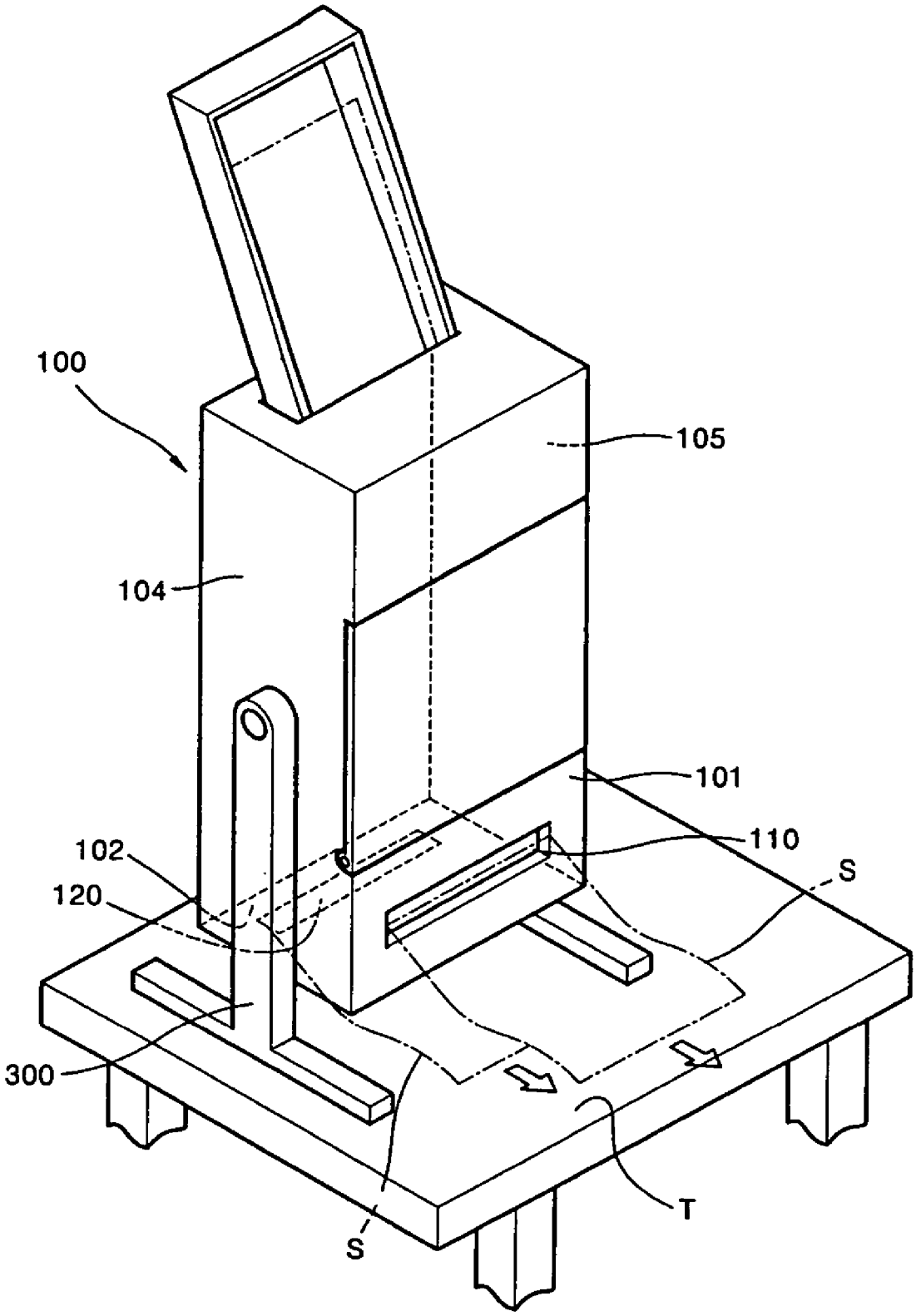
FIGS. 6 and 7 are perspective views illustrating an eletrophotographic image forming apparatus with a stand according to another embodiment of the present general inventive concept.
Figure 7:
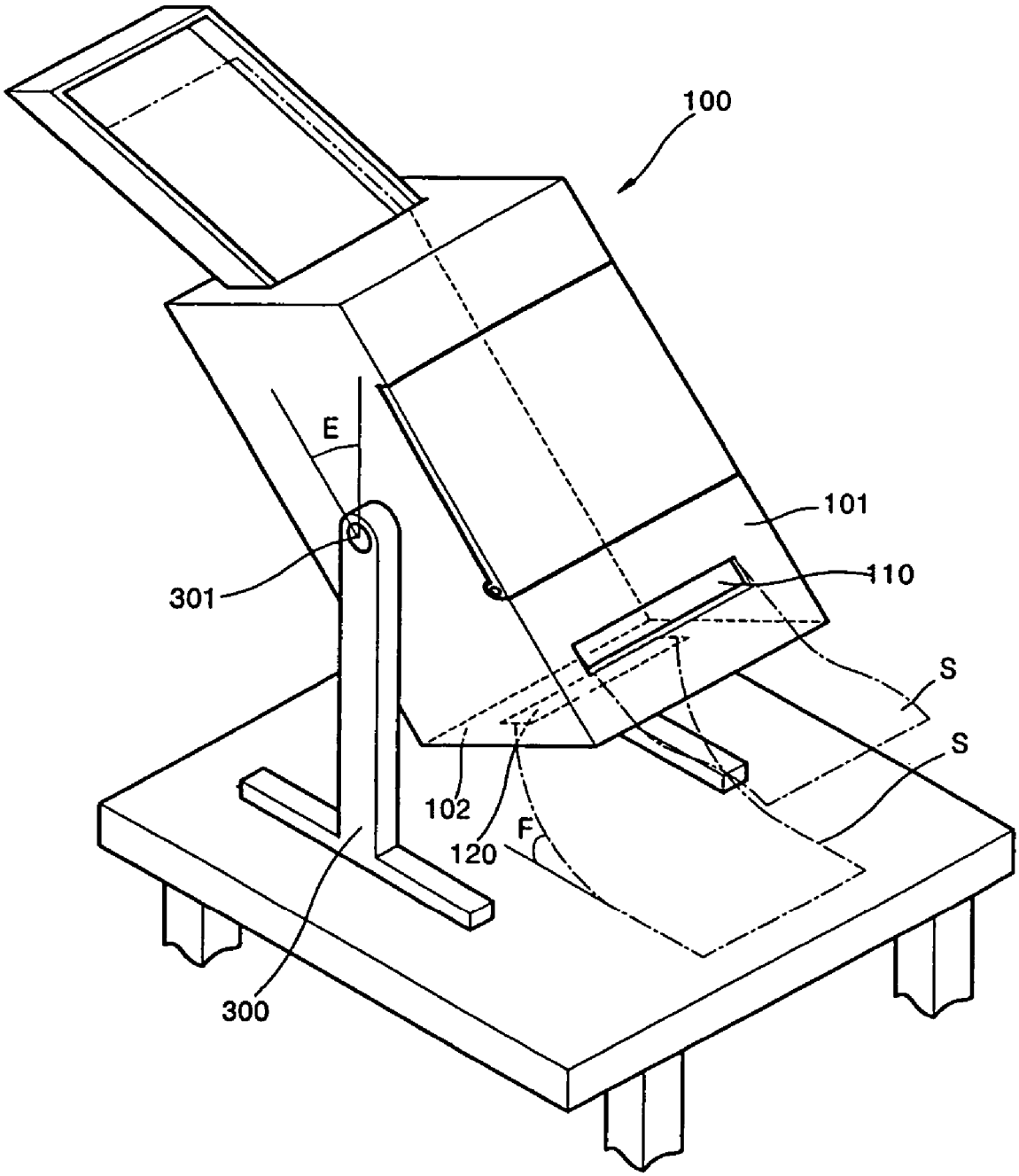

FIGS. 6 and 7 are perspective views illustrating an electrophotographic image forming apparatus according to another embodiment of the present invention. Referring to FIG. 6, an electrophotographic image forming apparatus of FIG. 2 or 5 may further include a stand 300 to support the housing 100 containing the print unit 200. The stand 300 can support a right side 105 and a left side 104 of the housing 100 in order to form a space between the lower surface 102 of the housing 100 and a table T (installation surface) where the electrophotographic image forming apparatus is installed. In accordance with the above described structure, the sheets of paper S discharged from the outlets 110 and 120 are naturally stacked in the space between the table T and the housing 100.

Referring to FIG. 7, the housing 100 may be installed to have another slope angle E to the stand 300. Also, the stand 300 and the housing 100 can be combined by a hinge 301 in order to control the housing 100 to slant by a voluntary angle. In accordance with the above structure, discharge of the sheet of paper S can be smoothly performed due to an angle F formed by the table T and the sheet of paper S discharged from the outlet 120 provided at the lower part 102 of the housing 100.

Figure 8:
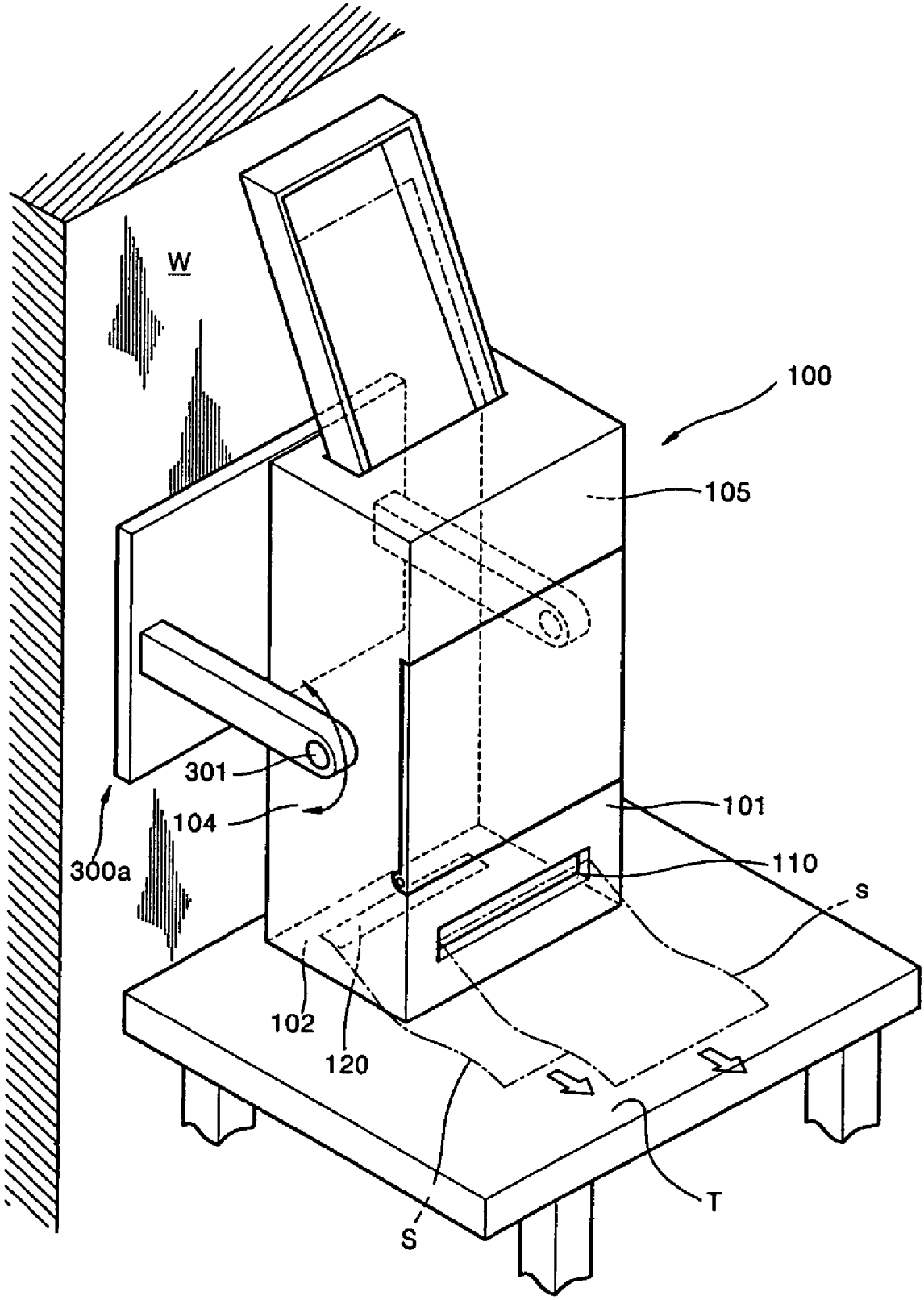
FIG. 8 is a perspective view illustrating an eletrophotographic image forming apparatus according to another embodiment of the present general inventive concept.

The stand 300 can provide a natural discharge of the sheet of paper S by detaching the lower surface 102 of the housing 100 from the table T, and a structure for the natural discharge may not be restricted to the structure as shown in FIGS. 6 and 7. In an aspect of the present general inventive concept, the stand 300*a* can be fixedly coupled to a wall W as shown in FIG. 8. The housing 100 may be installed to have an angle with the stand 300*a* as shown in FIG. 7, and the stand 300*a* and the housing 100 may be combined by the hinge 301 so as to control the housing 100 to be inclined by a voluntary (desirable) angle.

As described above, an electrophotographic image forming apparatus according to the present general inventive concept has the following advantages.

First, a space of an office may be efficiently used because a footprint of the electrophotographic image forming apparatus becomes smaller.

Second, a toner consumption efficiency may be improved, and a toner's life span can be extended because toner in a toner container is naturally transported by the weight of the toner. Also, a stabilized quality of an image can be obtained because the toner is supplied with stability to a developing roller.

Third, materialization of goods useful for protecting environment is possible because the toner in a developing unit is completely used.

Fourth, printed sheets of paper can be naturally discharged and stacked, with including a stand.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electrophotographic image forming apparatus comprising a paper cassette and a print unit which prints an image on a sheet of paper in accordance with an electrophotographic process, and a housing containing the print unit, the print unit comprising:

a photosensitive drum;

an exposure unit which forms an electrostatic latent image by radiating light corresponding to image information on the photosensitive drum;

a developing unit which is installed above the photosensitive drum to develop the electrostatic latent image with toner;

a pickup roller installed above the photosensitive drum to pick up the sheet of paper from a paper feed cassette and transfer the sheet of paper toward the photosensitive drum; and a paper transportation path installed along a rear side of the housing and extended below from the pickup roller to transfer the developed image to the sheet of paper, and to guide the sheet of paper to an outlet provided in a front side of the housing, wherein the exposure unit is installed at the front side of the housing and the developing unit is horizontally disposed between the paper transportation path and the exposure unit.

2. The electrophotographic image forming apparatus of claim 1, wherein the developing unit comprises a toner container to contain the toner, and a developing roller installed at a front end of the toner container to form a toner image by supplying the toner to the electrostatic latent image, the toner container installed to be extended upward from the developing roller within a range of ±45° vertically from the front end thereof, the toner container having a height longer than a width.

3. The electrophotographic image forming apparatus of claim 2, wherein the developing roller is installed within a range of ±45° vertically from a center of the photosensitive drum.

4. The electrophotographic image forming apparatus of claim 1, wherein the pickup roller is installed within a range of ±45° vertically from a center of the photosensitive drum.

5. The electrophotographic image forming apparatus of claim 1, further comprising a door that is installed on a front surface of the housing to be opened and closed in order to exchange the developing unit.

6. The electrophotographic image forming apparatus of claim 5, wherein the exposure unit is installed on the door.

7. An electrophotographic image forming apparatus comprising:

a housing having a bottom, one or more sidewalls extended from the bottom to form an angle with the bottom, a top wall coupled to the one or more sidewalls to cover an open end defined by the one or more sidewalls, and a door formed on a side of the one or more sidewalls;

an inlet formed on the top wall;

a paper cassette to be installed in the housing through the inlet to contain a sheet of paper;

an outlet formed on the side of the one or more sidewalls of the housing to discharge the sheet of paper outside the housing;

a pickup roller disposed to pick up the sheet of paper from the paper cassette;

a feed roller to feed the picked-up sheet of paper along a first paper path;

a photosensitive drum;

a transfer roller disposed to contact the photosensitive drum to transfer a toner image of the photosensitive drum to the sheet of paper fed along the first paper path, and to feed the sheet of paper with the transferred toner image along a second paper path;

a fixing unit to fix the transferred toner image of the sheet of paper to discharge the sheet of paper outside the housing through the outlet along a third paper path;

a developing unit disposed between the first paper path and the one or more sidewalls to develop an electrostatic latent image with toner; and an exposure unit disposed between the development unit and the one or more sidewalls to form the electrostatic latent image on the photosensitive drum.

8. The electrophotographic image forming apparatus of claim 7, wherein the housing comprises an opening formed on a side of the one or more sidewalls, and a door to cover the opening.

9. The electrophotographic image forming apparatus of claim 8, wherein the exposure unit is installed in the door.

10. The electrophotographic image forming apparatus of claim 7, wherein the developing unit comprises a toner container to contain the toner, and a developing roller installed at a front end of the toner container to form the toner image by supplying the toner to the electrostatic latent image, the toner container installed to be extended upward from the developing roller within a range of ±45° vertically from the front end thereof, the toner container having a height longer than a width.

11. The electrophotographic image forming apparatus of claim 10, wherein the developing roller is installed within a range of ±45° vertically from a center of the photosensitive drum.

12. The electrophotographic image forming apparatus of claim 7, wherein the pickup roller is installed within a range of ±45° vertically from a center of the photosensitive drum.

13. An electrophotographic image forming apparatus comprising:

a housing having a bottom, a rear wall, and a front wall extended from the bottom to form an angle with the bottom, and a top wall coupled to the rear wall and the front wall to cover an open end defined by the rear wall and the front wall;

an inlet formed on the top wall;

an outlet formed on each of the bottom and the front wall;

a plurality of rollers including a pick-up roller to feed a sheet of paper in a direction from the inlet to the outlet;

a photosensitive drum having a center passing a line parallel to the rear wall and the front wall;

a developing unit having a toner container to supply toner to the photosensitive drum in a direction parallel to the line to develop an electrostatic latent image of the photosensitive drum; and an exposure unit disposed between the developing unit and the front wall to form the electrostatic latent image on the photosensitive drum.

14. An electrophotographic image forming apparatus, comprising:

a housing to house a print unit;

a paper feeding cassette installed vertically in the housing and having one or more sheets of paper; and a plurality of imaging components defining a paper transportation path from a top portion of the housing to a bottom portion of the housing, the paper transportation path including a first outlet disposed on a bottom surface of the housing and a second outlet disposed on a side surface of the housing, wherein the one or more sheets of paper exit the housing in a direction parallel with the bottom surface of the housing.

15. The electrophotographic image forming apparatus of claim 14, wherein the paper feeding cassette extends upward from the top portion of the housing.

16. The electrophotographic image forming apparatus of claim 13, further comprising:

a paper feeding cassette detachably installed in the housing through the inlet formed on the top wall.

* * * * *